US008677587B2

(12) United States Patent
Liu

(10) Patent No.: US 8,677,587 B2
(45) Date of Patent: Mar. 25, 2014

(54) MODULAR PNEUMATIC FASTENING DEVICE

(76) Inventor: Pao-Fang Liu, Miaoli Hsien (TW)

( * ) Notice: Subject to any disclaimer, the term of this patent is extended or adjusted under 35 U.S.C. 154(b) by 98 days.

(21) Appl. No.: 13/451,271

(22) Filed: Apr. 19, 2012

(65) Prior Publication Data

US 2013/0104360 A1 May 2, 2013

(30) Foreign Application Priority Data

Oct. 28, 2011 (TW) ..... 100139313 A

(51) Int. Cl.
*B21J 15/20* (2006.01)

(52) U.S. Cl.
USPC ..... 29/243.525; 29/243.523

(58) Field of Classification Search
USPC ..... 29/243.523, 243.524, 243.525; 72/391.4, 391.6
See application file for complete search history.

(56) References Cited

U.S. PATENT DOCUMENTS

| | | | | |
|---|---|---|---|---|
| 5,490,312 | A * | 2/1996 | Smith | 29/243.525 |
| 6,272,899 | B1 | 8/2001 | Bentivogli | |
| 6,425,170 | B1 * | 7/2002 | Zirps et al. | 29/243.525 |
| 6,622,363 | B2 * | 9/2003 | Komsta | 29/243.525 |
| 6,651,301 | B1 | 11/2003 | Liu | |
| 7,043,807 | B2 * | 5/2006 | Woyciesjes et al. | 29/243.525 |

* cited by examiner

*Primary Examiner* — David B Jones
(74) *Attorney, Agent, or Firm* — Muncy, Geissler, Olds & Lowe, P.C.

(57) ABSTRACT

An approach is provided for modular pneumatic fastening device for operating a fastening component. The device comprises a main body, a motive module, a first fast-detaching module and a second fast-detaching module. The motive module being mounted on a top of the main body and comprises a first protrusion and a second protrusion. The first fast-detaching module is attached to the rear end of the motive module, and has a first recess connected to the first protrusion. The second fast-detaching module is attached to the front end of the motive module, is configured for operating the fastening component with the corresponding first fast-detaching module, and has a second recess connected to the second protrusion. Therefore, the first fast-detaching module and the second fast-detaching module can be replaced together pairwise by the recesses attaching or detaching the protrusion, which fit for the fastening component to be operated.

17 Claims, 7 Drawing Sheets

MODULAR PNEUMATIC FASTENING DEVICE

FIELD OF THE INVENTION

Embodiments of the invention relate to hand tool machineries, and in particular to a modular pneumatic fastening device, capable of implementing fasteners to have different operation characteristics through module replacement.

BACKGROUND

Fastening piece is a fundamental fastening component used widely in the Industries. Rivet Nuts and blind rivets, among various fastening components, are considered as similar components, but their ways of operation and results achieved are quite different. Please refer to U.S. Pat. No. 6,272,899B1 "Pneumatic-hydraulic rivet gun" for information of a rivet nut tool. Further, refer to U.S. Pat. No. 6,651,301B1 "Adjustable hand tool with dual functions" for more information about a blind rivet retriever.

Refer to FIG. 1 for a schematic diagram of a known structure of an Air Rivet Nut Tool. As shown in FIG. 1, the operation process of the rivet nuts 100 riveting is that, a pneumatic motor 101 is used to bring a screw 102 into forward or reverse rotation to fix or detach the rivet nuts 100. The pressing into shape of rivet nuts 100 is realized through reciprocal movements of a rivet nut push rod 103.

Refer to FIG. 2 for a schematic diagram of a known structure of an Air blind Rivet Riveter. As shown in FIG. 2, the operation process of the rivet riveting is that, a rivet fixing piece 201 capable of engaging a rivet 200 is made to engage the rivet 200, and through a rivet push rood 202, push the rivet end of the rivet 200 to press it backward and cut it off, to cause end portion of rivet 200 to press into shape.

According to FIGS. 1 and 2, the two pneumatic Air Rivet Nut Tool and Air Rivet Riveter are both hand tools looking similar, yet their operation principles are quite different, therefore, it is rather difficult to integrate them into a whole unit. For example, in making pneumatic Air Rivet Nut Tool-based improvement of device, since a pneumatic motor must be placed behind the rivet nut push rod of the pneumatic Air Rivet Nut Tool to bring a screw into action; and while performing Rivet riveting operations. The existence of the pneumatic motor, may cause structure conflict between means for receiving rivet end, and means for exiting rivet end during the rivet riveting operation, therefore, there are tremendous difficulties in adapting pneumatic air rivet nut tool for rivet riveting purpose.

In contrast, in making pneumatic Air Rivet Riveter-based improvement of device, since the air Rivet Nut Tool must form connection with rivet nuts through a screw at front end, and the screw can be driven only through the pneumatic motor, thus the placement of screw and pneumatic motor will cause structure conflict between the engage-fixing piece in the air rivet riveter and movement of rivet push rod. Thus, it would be rather difficult to adapt the pneumatic rivet riveter for rivet nut riveting purpose.

Therefore, there is a need for an approach to provide a mechanism or a device that can adapt to rivet nut riveting and blind rivet riveting functions together without causing structure conflicts in operation.

SOME EXEMPLARY EMBODIMENTS

These and other needs are addressed by the invention, wherein an approach is provided for selectively attaching and detaching modules of a modular pneumatic fastening device for different types of fastening components.

Another approach is provided for a modular pneumatic fastening device that is capable of integrating the rivet nut riveting and blind rivet riveting functions together without causing structure conflicts in operation.

According to one aspect of an embodiment of the invention, a modular pneumatic fastening device for operating a fastening component comprises a main body, a motive module, a first fast-detaching module and a second fast-detaching module. The motive module is mounted on a top of the main body and comprises a chamber, a first protrusion and a second protrusion.

The chamber is formed inside the motive module and having a front opening and a rear opening. The front opening is mounted on a front end of the chamber and the rear opening is mounted on a rear end of the chamber. The first protrusion is mounted on the rear end of the chamber, which is protruded from a perimeter rim of the rear opening. The second protrusion is mounted on a front end of the motive module.

The first fast-detaching module is attached to the rear end of the chamber, and has a first recess. The first recess is connected to the first protrusion, which allows the first fast-detaching module to be attached or detached from the chamber. The second fast-detaching module is attached to the front end of the chamber, is configured for operating the fastening component with the corresponding first fast-detaching module, and has a second recess. The second recess is connected to the second protrusion, which allows the second fast-detaching module to be attached to or detached from the chamber.

Accordingly, the modular pneumatic fastening device in accordance with embodiments of the present invention provides an integration of the rivet nut riveting and the blind rivet riveting functions through change of fastening components in such a device, to enhance the application of the modular pneumatic fastening device, and reduce expense of the customers.

Compared with the prior art, the modular pneumatic fastening device of the present invention has the following advantages:

1. Modularized design: in case the first fast-detaching module or the second fast-detaching module is damaged or in failure, it can be replaced easily, to save repair and maintenance time and cost 2. By replacing the first fast-detaching module and the second fast-detaching module together pair-wise, they can fit the fastening component to be operated, such that the fastening component is a rivet nut or a blind rivet;

3. In the process of changing fastening components, the first fast-detaching module and the second fast-detaching module are replaced together pair-wise, so the structure conflicts caused by different operation ways of rivet nut riveting operation and blind rivet riveting operation would not occur; and 4. Rivet nut and blind rivet requiring different ways of operation can be changed and implemented in the same main body, hereby increasing significantly the scope of application of modular pneumatic fastening device, and reducing the expense of the customer.

Still other aspects, features and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative, and not as restrictive.

BRIEF DESCRIPTION OF THE DRAWINGS

The invention is illustrated by way of example, and not by way of limitation, in the figures of the accompanying drawings in which like reference numerals refer to similar elements and in which.

DESCRIPTION OF THE PREFERRED EMBODIMENT

Figure 1:
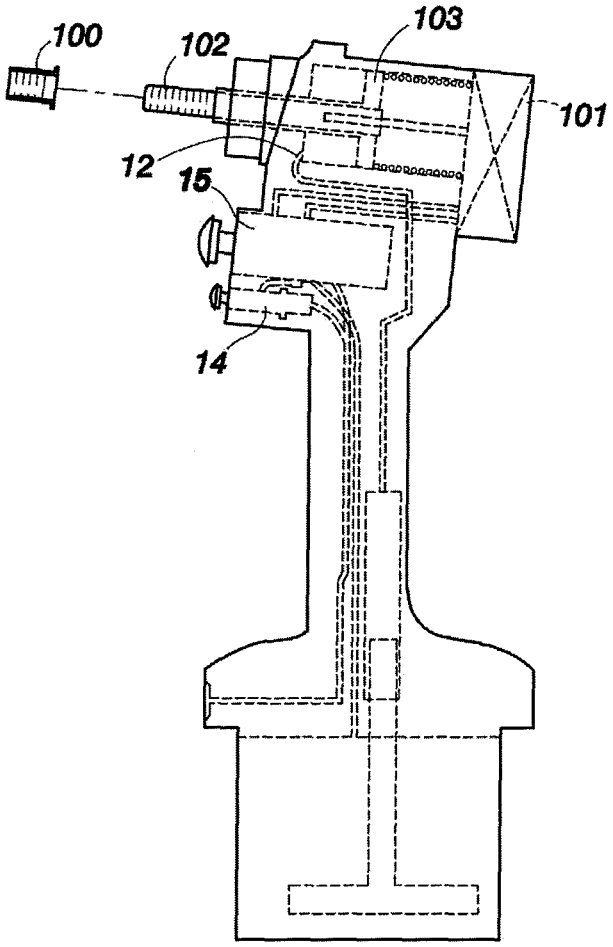
PRIOR ART FIG. 1
FIG. 1 is a schematic diagram of a known structure of an Air rivet nut tool.
Figure 2:
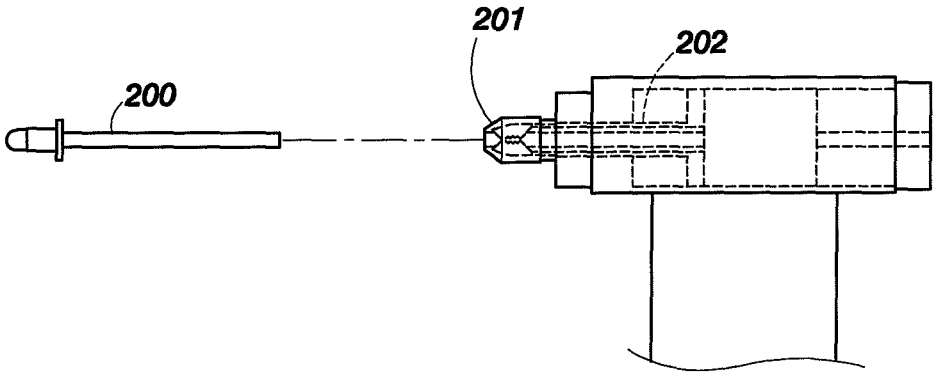
PRIOR ART FIG.2
FIG. 2 is a schematic diagram of a known structure of an Air blind rivet riveter.
Figure 3:
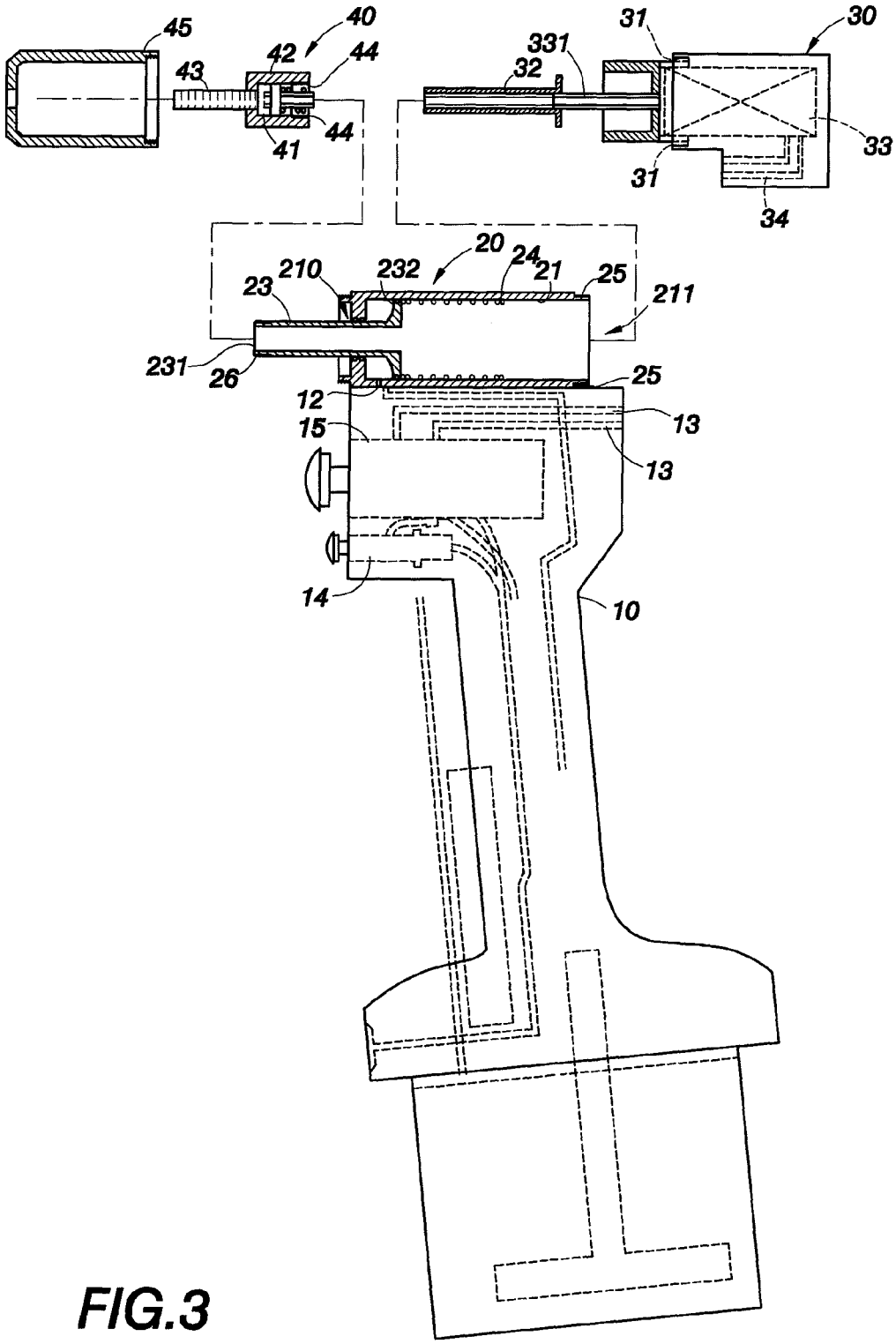
FIG. 3 is an exemplary exploded view of a modular pneumatic fastening device for a rivet nut in accordance with the present invention.
Figure 5:
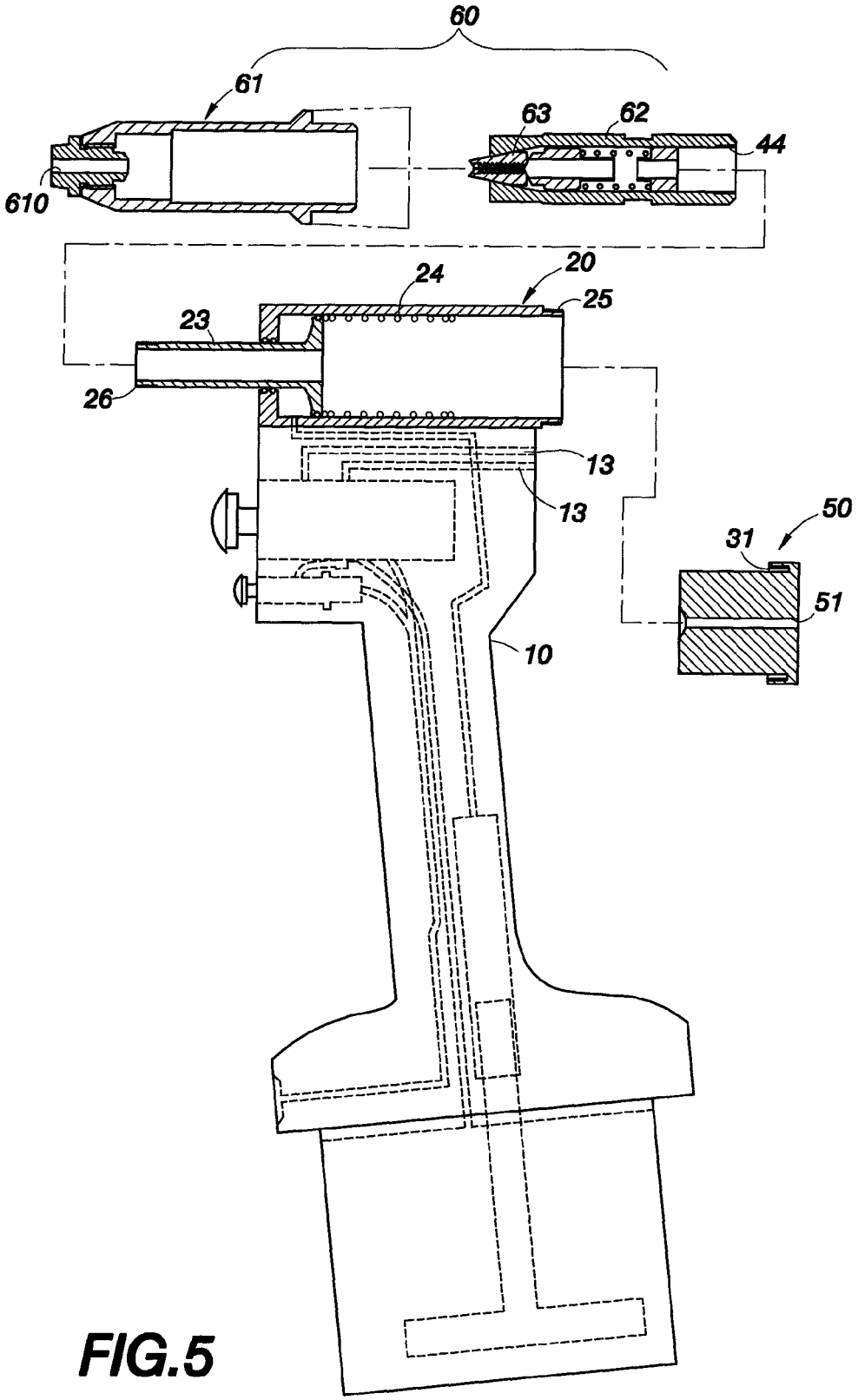
FIG. 5 is an exemplary exploded view of a modular pneumatic fastening device for a blind rivet in accordance with the present invention.

With reference to FIGS. 3 and 5, FIG. 3 is an exemplary exploded view of a modular pneumatic fastening device for a rivet nut in accordance with the present invention. FIG. 5 is an exemplary exploded view of a modular pneumatic fastening device for a blind rivet in accordance with the present invention.

A modular pneumatic fastening device for operating a fastening component comprises a main body 10, a motive module 20, a set of first fast-detaching modules 30, 50, and a set of second fast-detaching modules 40, 60. The main body 10 comprises an oil hole 12 a main control valve 15, two first air tunnels 13, and an auxiliary control valve 14. The oil hole 12 is mounted inside the main body 10 and penetrates toward a top surface of the main body 10. The two first air tunnels 13 are communicated with the main control valve 15 and the auxiliary control valve 14, and penetrate through a side surface of the main body 10.

The motive module 20 is mounted on a top of the main body 10, and comprises a chamber 21, a push rod 23, a resilient spring 24, a first protrusion 25 and a second protrusion 26. The chamber 21 is formed inside the motive module 20, and comprises a front opening 210 and a rear opening 211. The front opening 210 is mounted on a front end of the chamber 21. The rear opening 211 is mounted on a rear end of the chamber 21. The push rod 23 is inserted inside and protruded from the front end of the chamber 21, and comprises a connection port 231 and a piston 232. The connection port 231 of the push rod 23 is protruded from the front opening 210 of the chamber 21. The piston 232 is disposed inside and against an inner surface of the chamber 21. The resilient spring 24 is located inside the chamber 21, and against the piston 232. The first protrusion 25 is mounted on the rear end of the chamber 21, which is protruded from a perimeter rim of the rear opening 211. The second protrusion 26 is mounted on a front end of motive module (i.e., the push rod 23).

The structures and mechanisms aforementioned of the oil hole 12, the two air tunnels 13, and the auxiliary control valve 14 are the known art, and it will no be further described here for brevity. However, due to the viewing angle in the drawing, the two air tunnels 13 are presented in a parallel and up-and-down, manner. It is noted that a person skill in art will realize that the two air tunnels 13 can be located, not limited to, in a horizontal disposition.

The fast-detaching module 30, 50 is attached to the rear end of the chamber 21, and comprises a first recess 31. The first recess 31 is connected to the first protrusion 25 of the main body 10, which allows the fast-detaching module 30, 50 to be attached to or detached from the chamber 21.

The second fast-detaching module 40, 60 is attached to the front end of the chamber 21, is configured for operating the fastening component with the corresponding fast-detaching module 30, 50, and comprises a second recess 44. The second recess 44 is connected the second protrusion 26 of the motive module 20, which allows the second fast-detaching module 40, 60 to be attached to or detached from the chamber 21.

Accordingly, through the modular design of modular pneumatic fastening device, the first fast-detaching modules 30, 50 and the second fast-detaching modules 40, 60 can be replaced together pair-wise, to fit for the fastening component to be operated. Here below are two separate embodiments describing the module uses for different fastening components (i.e., rivet nut and blind rivet).

Figure 4:
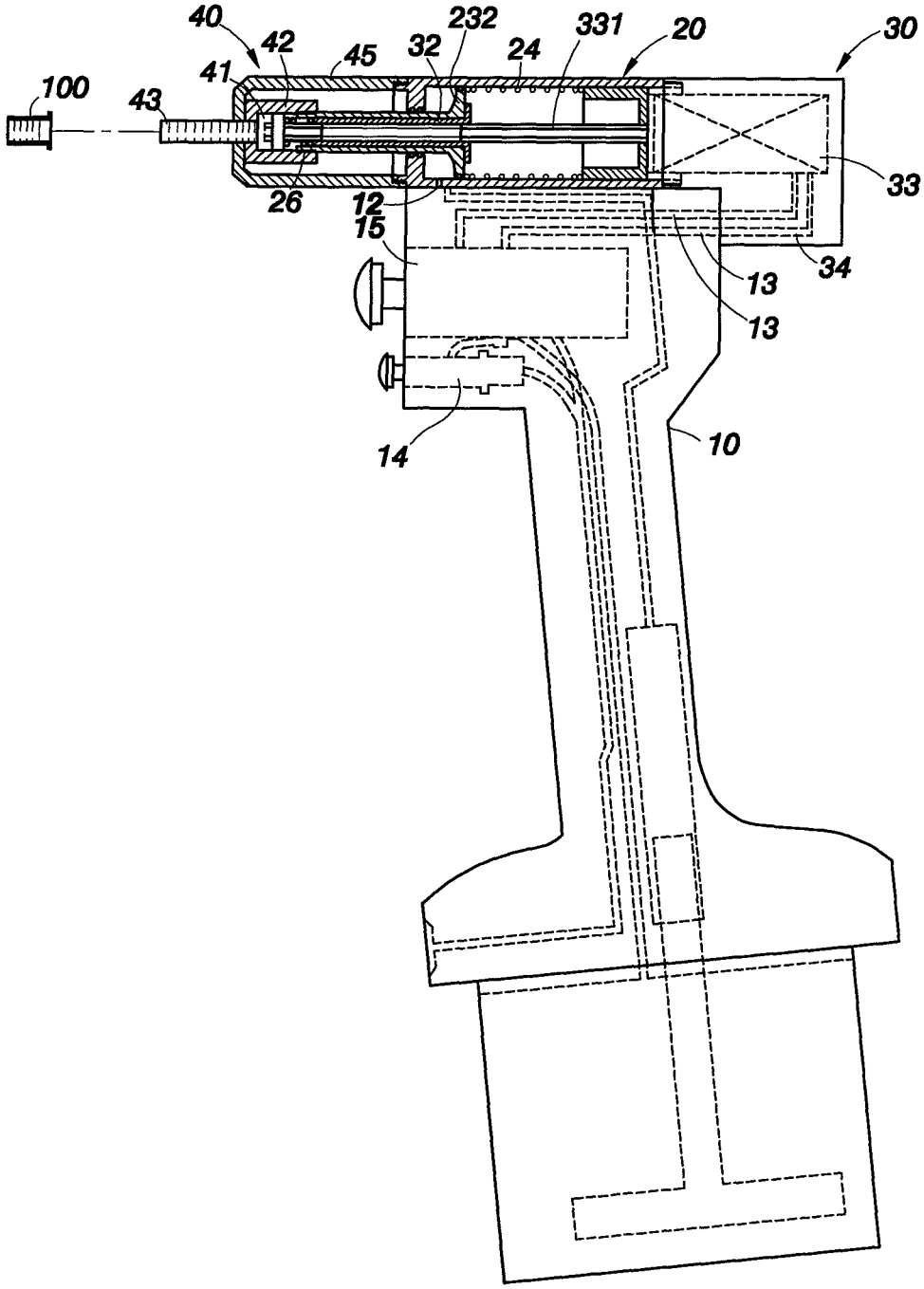
FIG. 4 is an exemplary diagram of a modular pneumatic fastening device for a rivet nut in accordance with the present invention.

With reference to FIGS. 3 and 4, FIG. 3 is an exemplary exploded view of a modular pneumatic fastening device for a rivet nut in accordance with the present invention. FIG. 4 is an exemplary diagram of a modular pneumatic fastening device for a rivet nut in accordance with the present invention. In this embodiment, the fastening component is a rivet nut 100.

In this embodiment, the first fast-detaching module 30 is in cooperation with the second fast-detaching module 40, and further comprises a rotation rod 32, a pneumatic motor 33 and two second air tunnels 34. The rotation rod 32 is protruded outside the first fast-detaching module 30 and is a hollow rod. The pneumatic motor 33 is located inside the first fast-detaching module 30, connects to the two first air tunnels 13 and the rotation rod 32, and comprises a pivot 331. The pivot 331 is connected to a rear end of the rotation rod 32 and forms a poly-angular column (i.e. a hexagonal column) matching structure with the rotation rod 32. The two second air tunnels 34 are communicated with the two air tunnels 13 of the main body 10.

The second fast-detaching module 40 comprises a fastening-piece-fixing-portion 41, a force-exerting portion 42, a rivet nut seat 45 and a screw 43. The fastening-piece-fixing-portion 41 is protrude outside the front end of the chamber 21, and is configured to fix the rivet nut 100. The force-exerting portion 42 is connected to the fastening-piece-fixing-portion 41 and is driven by the push rod 23 that creates a relative displacement to the fastening-piece-fixing-portion 41 for pressing the rivet nut 100 into shape. As shown in FIG. 4, the force-exertion portion 42 is a tup corresponding to a rim of the rivet nut 100. The rivet nut seat 45 surrounds the fastening-piece-fixing-portion 41 and the force-exerting portion 42, and is configured for inserting and engaging the rivet nut 100. The screw 43 is mounted on a front end of the force-exerting portion 42.

Accordingly, the pneumatic motor 33 adjusts supplying air directions of the two first air tunnels 13 through the main control valve 15, which switches the engaging configuration of the screw 43 and the rivet nut 100. In such manner, a person is able to operate the modular pneumatic fastening device by the main control valve 15 and the auxiliary control valve 14 in a fluid driving manner that performs the processes of fixing, detaching and pressing into shape of the rivet nut 100.

For example, when a person put the rivet nut 100 into the screw 43, the person is able to press the main control valve 15 to a first stage that makes air from an externally connected air compressor (not shown) flowing into the one of the two first air tunnels 13. The inputted air then flows into and drives the pneumatic motor 33 into rotation that drives the rotation rod 32 and the second fast-detaching module 40, and thus drives the rivet nut 100 into the screw 43.

Moreover, the person may press the main control valve 15 to a second stage that makes the air of the air compressor flow inside an air cylinder (not shown) at the bottom of the main body 10 for pushing the push rod 23 in the air cylinder upward (this belongs to the known art and will not be needed for further description). The upward push rod 23 will guide oil to a space in front of the piston 232 through the oil hole 12. The guided oil produces a pressure that pushes the piston 232 backward. When a person releases the main control valve 15, the air inside the air cylinder will flow to the pneumatic motor 33 through another one of the two first air tunnels 13, and rotates the pneumatic motor 33 in an inverse direction that is corresponded to the direction for engaging the rivet nut 100. The inverse direction rotation of the pneumatic motor 33 will detach the rivet nut 100 from the screw 43.

In case that the rivet nut 100 has not been detached out from the screw 43 completely, the person may further press the auxiliary control valve 14 to make an additional air of the air compressor to get into one of the two first air tunnels 13, and thus to rotate the pneumatic motor 33. Such additional air from the compressor to the two first air tunnels 13 selectively goes the same tunnel as the air in the air cylinder.

Figure 6:
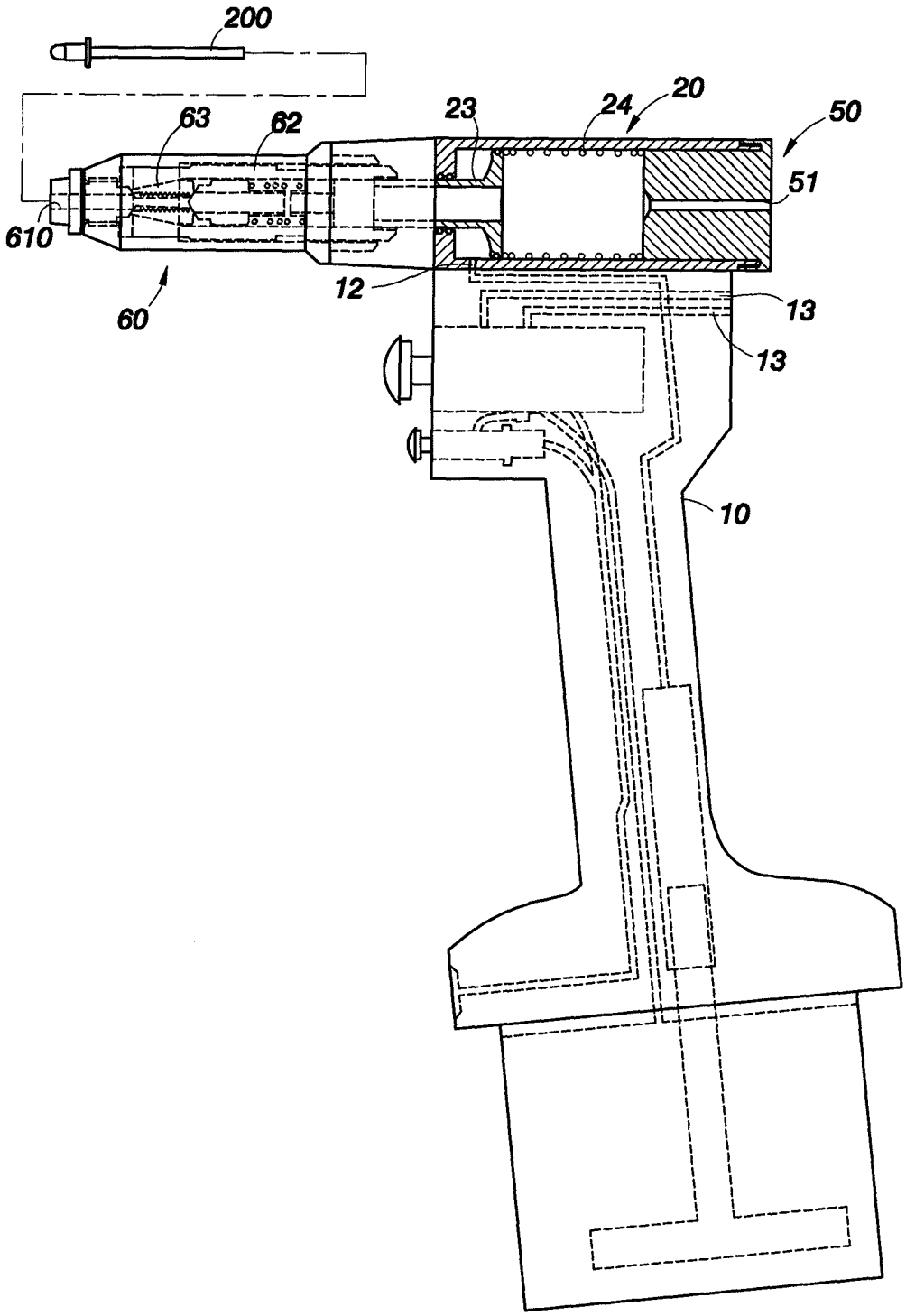
FIG. 6 is an exemplary diagram of a modular pneumatic fastening device for a blind rivet in accordance with the present invention.

With reference to FIGS. 5 and 6, FIG. 5 is an exemplary exploded view of a modular pneumatic fastening device for a blind rivet in accordance with the present invention. FIG. 6 is an exemplary diagram of a modular pneumatic fastening device for a blind rivet in accordance with the present invention. In this embodiment, the fastening component is a blind rivet 200.

In this embodiment, the first fast-detaching module 50 is cooperated with the second fast-detaching module 60. It is noted that the first fast-detaching module 50 is not connected to the two first air tunnel 13 of the main body 10, and it does not have a pneumatic motor 33 as previously mentioned embodiment (see FIG. 3). Further, due to the process of riveting the blind rivet 200 into shape requires to cut off the tail nail of blind rivet 200, the first fast-detaching module 50 comprises an ejecting hole 51 for the convenience of ejecting the tail nail. In other words, when operating the rivet nut 100, the modular pneumatic fastening device uses the first fast-detaching module 30 and the second fast-detaching module 40 together. When operating the blind rivet 200, the modular pneumatic fastening device uses the first detaching module 50 and the second detaching module 60 together.

The second fast-detaching module 60 comprises a sleeve seat 61, an jawcase 62 and a pair of jaws 63. The sleeve seat 61 is configured for engaging the blind rivet 200, and comprises an insertion hole 610, and the insertion hole 610 is configured for inserting the blind rivet 200. The jaws 63 are covered with the jawcase 62, and is connected to the insertion hole 610. As shown in FIG. 6, the jawcase 62 is a pulling tube in contact with the sleeve seat 61, and is configured for creating a relative displacement to the motive module 20 that gears with the jaws 63 for the insertion of the blind rivet 200.

Figure 7:
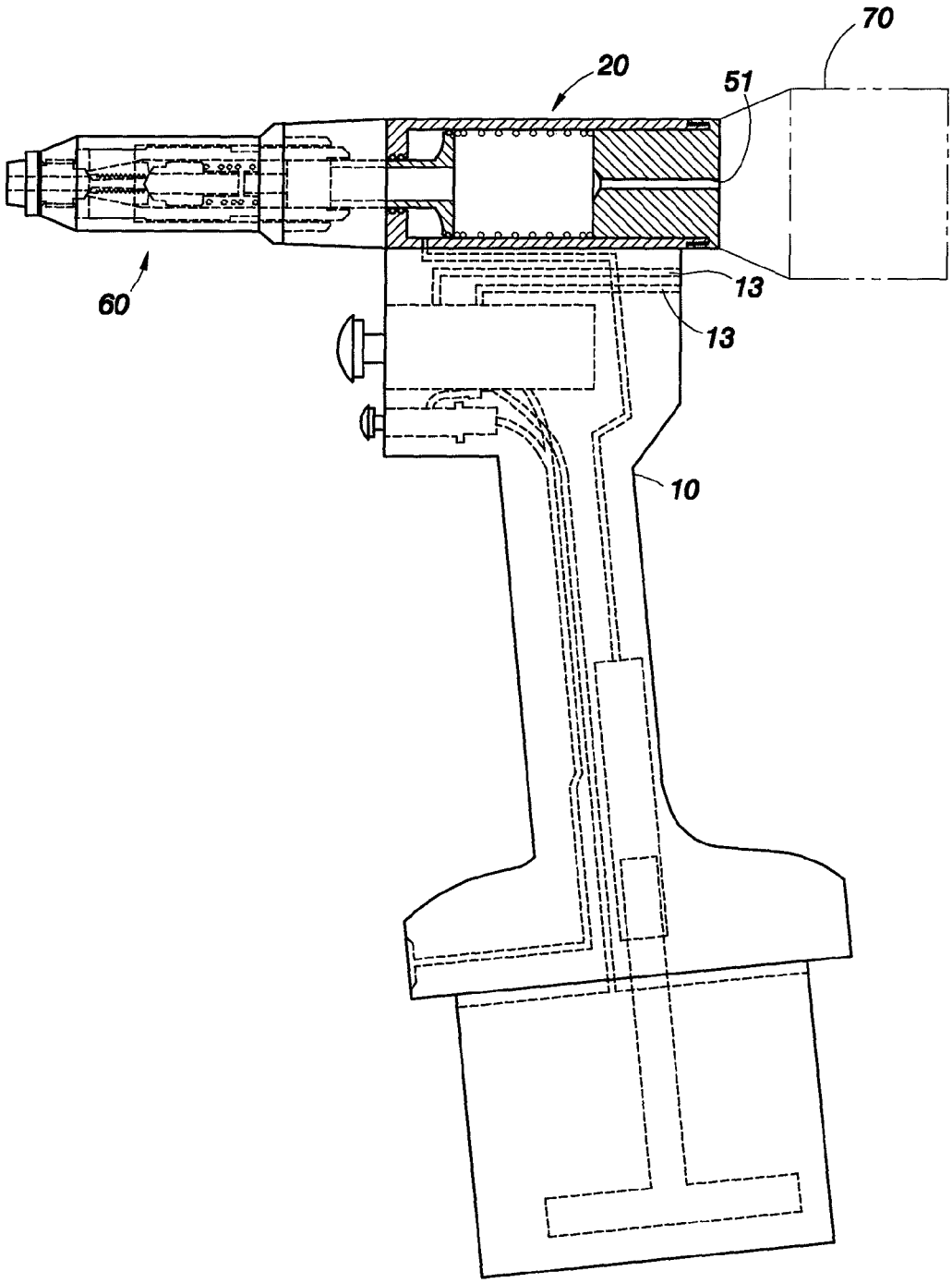
FIG. 7 is a schematic diagram of a modular pneumatic fastening device with an added rivet collection device of FIG. 6 in accordance with an embodiment of the present invention.

Further with reference to FIG. 7, FIG. 7 is a schematic diagram of a modular pneumatic fastening device with an added rivet collection device of FIG. 6 in accordance with an embodiment of the present invention. In this embodiment, the modular pneumatic fastening device further comprises a rivet collection device 70. The rivet collection device 70 is connected to a rear end of the first fast-detaching module 50, which facilitates rivets riveting operation.

Accordingly, as above described embodiment respectively in FIGS. 4 and 6, the first fast-detaching module and the second fast-detaching module are replaced together pairwise, so the structure conflicts caused by different operation ways of rivet nut riveting operation and blind rivet riveting operation would not occur. Therefore, as rivet nut and blind rivet requiring different ways of operations, modules can be changed and implemented in the same main body, so that the modular pneumatic fastening device can be used for fastening both rivet nut 100 and blind rivet 200, hereby increasing its applicability significantly.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A modular pneumatic fastening device for operating a fastening component comprising:

a main body comprising:

a main control valve inside the main body;

an auxiliary control valve inside the main body;

an oil hole situated inside the main body and extended toward a top surface of the main body; and two first air tunnels situated inside the main body and communicated with the main control valve and the auxiliary control valve, and extended to a side surface of the main body;

a motive module being mounted on the top surface of the main body and comprising:

a chamber being formed inside the motive module and having a front opening and a rear opening, wherein the front opening is mounted on a front end of the chamber and the rear opening is mounted on a rear end of the chamber;

a first protrusion being mounted on the rear end of the chamber, which is protruded from a perimeter rim of the rear opening; and a second protrusion being mounted on a front end of the motive module;

a first fast-detaching module being attached to the rear end of the chamber, and having a first recess, wherein the first recess is connected to the first protrusion, which allows the first fast-detaching module to attach or detach from the chamber; and a second fast-detaching module being attached to the front end of the chamber, being configured for operating the fastening component with the corresponding first fast-detaching module, and having a second recess, wherein the second recess is connected to the second protrusion, which allows the second fast-detaching module to attach or detach from the chamber.

2. The modular pneumatic fastening device as claimed in claim 1, wherein the motive module further comprises:

a push rod inserted inside and protruded from the front end of the chamber and having a connection port and a piston, wherein the connection port is protruded from the front opening of the chamber, and the piston is disposed inside and against an inner surface of the chamber; and a resilient spring located inside the chamber, and against the piston.

3. The modular pneumatic fastening device as claimed in claim 2, wherein the fastening component is a blind rivet.

4. The modular pneumatic fastening device as claimed in claim 3, wherein the first fast-detaching module comprises an ejecting hole for ejecting rivet stems.

5. The modular pneumatic fastening device as claimed in claim 4, wherein the second fast-detaching module comprises:

a jawcase;

a sleeve seat configured for engaging the blind rivet, and having an insertion hole, wherein the insertion hole is configured for inserting the blind rivet; and a pair of jaws covered with the jawcase, and connected to the insertion hole, wherein the jawcase is a pulling tube connected to the sleeve seat, and configured for creating a relative displacement to the motive module that gears with the jaws for the insertion of the blind rivet.

6. The modular pneumatic fastening device as claimed in claim 5, wherein the jawcase is a pulling tube.

7. The modular pneumatic fastening device as claimed in claim 5, further comprising a rivet collection device being connected to a rear end of the first fast-detaching module.

8. The modular pneumatic fastening device as claimed in claim 2, wherein the fastening component is a rivet nut.

9. The modular pneumatic fastening device as claimed in claim 8, wherein the first fast-detaching module comprises:

a rotation rod protruded outside the first fast-detaching module; a pneumatic motor located inside the first fast-detaching module, and connected to the two first air tunnels and the rotation rod; and two second air tunnels communicated with the two first air tunnels.

10. The modular pneumatic fastening device as claimed in claim 9, wherein the pneumatic motor further comprises a pivot, and the pivot is connected to a rear end of the rotation rod and forms a poly-angular column matching structure with the rotation rod.

11. The modular pneumatic fastening device as claimed in claim 9, wherein the second fast-detaching module comprises:

a fastening-piece-fixing-portion protruded outside the front end of the chamber, and configured to fix the rivet nut;

a force-exerting portion connected to the fastening-piece-fixing-portion and driven by the push rod that creates a relative displacement to the fastening-piece-fixing-portion for pressing the rivet nut into shape;

a rivet nut seat surrounding the fastening-piece-fixing-portion and the force-exerting portion, and configured for inserting and engaging the rivet nut; and a screw mounted on a front end of the force-exerting portion.

12. The modular pneumatic fastening device as claimed in claim 11, wherein the force-exertion portion is a tup corresponding to a rim of the rivet nut.

13. A modular pneumatic fastening device for operating a fastening component comprising:

a main body;

a motive module being mounted on a top of the main body and comprising:

a chamber being formed inside the motive module and having a front opening and a rear opening, wherein the front opening is mounted on a front end of the chamber and the rear opening is mounted on a rear end of the chamber;

a first protrusion being mounted on the rear end of the chamber, which is protruded from a perimeter rim of the rear opening;

a second protrusion being mounted on a front end of the motive module;

a push rod is inserted inside and protruded from the front end of the chamber and has a connection port and a piston, wherein the connection port of the push rod is protruded from the front opening of the chamber, and the piston is disposed inside and against an inner surface of the chamber; and a resilient spring is located inside the chamber, and against the piston;

a first fast-detaching module being attached to the rear end of the chamber, and having a first recess, wherein the first recess is connected to the first protrusion, which allows the first fast-detaching module to attach or detach from the chamber; and a second fast-detaching module being attached to the front end of the chamber, being configured for operating the fastening component with the corresponding first fast-detaching module, and having a second recess, wherein the second recess is connected to the second protrusion, which allows the second fast-detaching module to attach or detach from the chamber;

wherein the fastening component is a rivet nut.

14. The modular pneumatic fastening device as claimed in claim 13, wherein the first fast-detaching module comprises:

a rotation rod protruded outside the first fast-detaching module;

a pneumatic motor located inside the first fast-detaching module, and connected to the two first air tunnels and the rotation rod; and two second air tunnels communicated with the two first air tunnels.

15. The modular pneumatic fastening device as claimed in claim 14, wherein the pneumatic motor further comprises a pivot, and the pivot is connected to a rear end of the rotation rod and forms a poly-angular column matching structure with the rotation rod.

16. The modular pneumatic fastening device as claimed in claim 14, wherein the second fast-detaching module comprises:

a fastening-piece-fixing-portion protruded outside the front end of the chamber, and configured to fix the rivet nut;

a force-exerting portion connected to the fastening-piece-fixing-portion and driven by the push rod that creates a relative displacement to the fastening-piece-fixing-portion for pressing the rivet nut into shape;

a rivet nut seat surrounding the fastening-piece-fixing-portion and the force-exerting portion, and configured for inserting and engaging the rivet nut; and a screw mounted on a front end of the force-exerting portion.

17. The modular pneumatic fastening device as claimed in claim 16, wherein the force-exertion portion is a tup corresponding to a rim of the rivet nut.

* * * * *